US007168453B2

(12) United States Patent
Chon et al.

(10) Patent No.: US 7,168,453 B2
(45) Date of Patent: Jan. 30, 2007

(54) MULTI WEFTS INSERTING WEAVING MACHINE FOR LATTICE WOVEN STRUCTURE

(75) Inventors: Jin Sung Chon, Daegu (KR); Chang Kwon Lee, Daegu (KR); Seong Ho Cho, Daejeon (KR); Dong Hwan Cha, Daejeon (KR)

(73) Assignees: T-FOR-L Co., Ltd., Daegu (KR); Samyang Corporation, Seoul (KR)

( * ) Notice: Subject to any disclaimer, the term of this patent is extended or adjusted under 35 U.S.C. 154(b) by 0 days.

(21) Appl. No.: 11/426,695

(22) Filed: Jun. 27, 2006

(65) Prior Publication Data

US 2006/0225806 A1 Oct. 12, 2006

Related U.S. Application Data

(63) Continuation of application No. PCT/KR04/03365, filed on Dec. 21, 2004.

(51) Int. Cl.
*D03D 41/00* (2006.01)
*D03D 3/00* (2006.01)
*D03D 13/00* (2006.01)

(52) U.S. Cl. ..... 139/11; 139/DIG. 1; 442/203; 442/205

(58) Field of Classification Search ..... 139/11, 139/DIG. 1; 442/203, 205
See application file for complete search history.

(56) References Cited

U.S. PATENT DOCUMENTS 3,955,602 A * 5/1976 King ..... 139/11
4,001,478 A * 1/1977 King ..... 442/205
4,038,440 A * 7/1977 King ..... 442/205
4,411,722 A 10/1983 Yazawa et al.
4,725,485 A * 2/1988 Hirokawa ..... 442/187
5,085,252 A * 2/1992 Mohamed et al. ..... 139/22
5,085,722 A 2/1992 Sikorski
5,137,058 A * 8/1992 Anahara et al. ..... 139/384 R
5,342,679 A * 8/1994 Aochi et al. ..... 428/113
5,348,056 A * 9/1994 Tsuzuki ..... 139/384 R
5,465,760 A * 11/1995 Mohamed et al. ..... 139/11
5,775,381 A * 7/1998 Addis ..... 139/11

(Continued)

FOREIGN PATENT DOCUMENTS

JP 02-229263 9/1990

(Continued)

OTHER PUBLICATIONS

International Search Report dated Mar. 30, 2005, received in related PCT Application No. PCT/KR2004/003365 (2 pages).

*Primary Examiner*—Gary L. Welch
*Assistant Examiner*—Robert H Muromoto, Jr.
(74) *Attorney, Agent, or Firm*—Grossman Tucker Perreault & Pfleger, PLLC

(57) ABSTRACT

A multi-wefts inserting weaving machine, comprising a block arraying device comprising an upper plate and a lower plate which face each other and are movable upward and downward; and a plural number of unit blocks attached to the internal facing sides of the upper plate and the lower plate of the block arraying device through combining grooves, wherein the unit blocks include two grooves. Accordingly, a lattice woven structure can be easily woven from heavy-duty materials by the present multi-wefts inserting weaving machine.

13 Claims, 10 Drawing Sheets

U.S. PATENT DOCUMENTS 5,791,384 A * 8/1998 Evans ..... 139/383 R
5,833,802 A * 11/1998 Yasui et al. ..... 156/510
6,003,563 A * 12/1999 Uchida et al. ..... 139/11
6,129,122 A * 10/2000 Bilisik ..... 139/11

FOREIGN PATENT DOCUMENTS

JP 07-145532 6/1995

* cited by examiner

【Fig. 1】
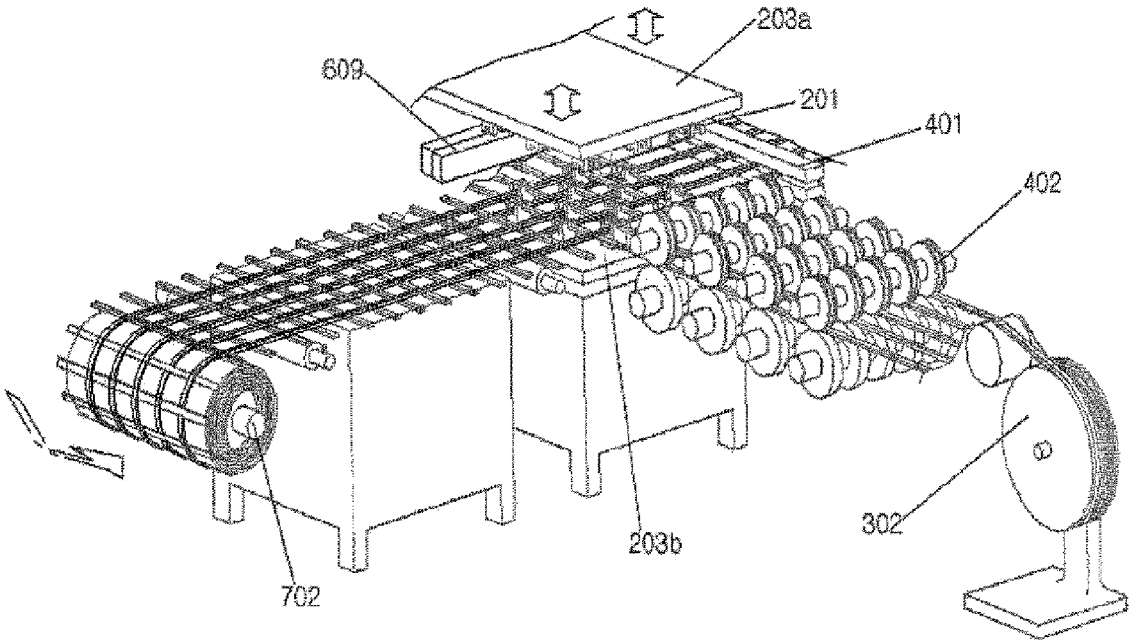

【Figure 2】
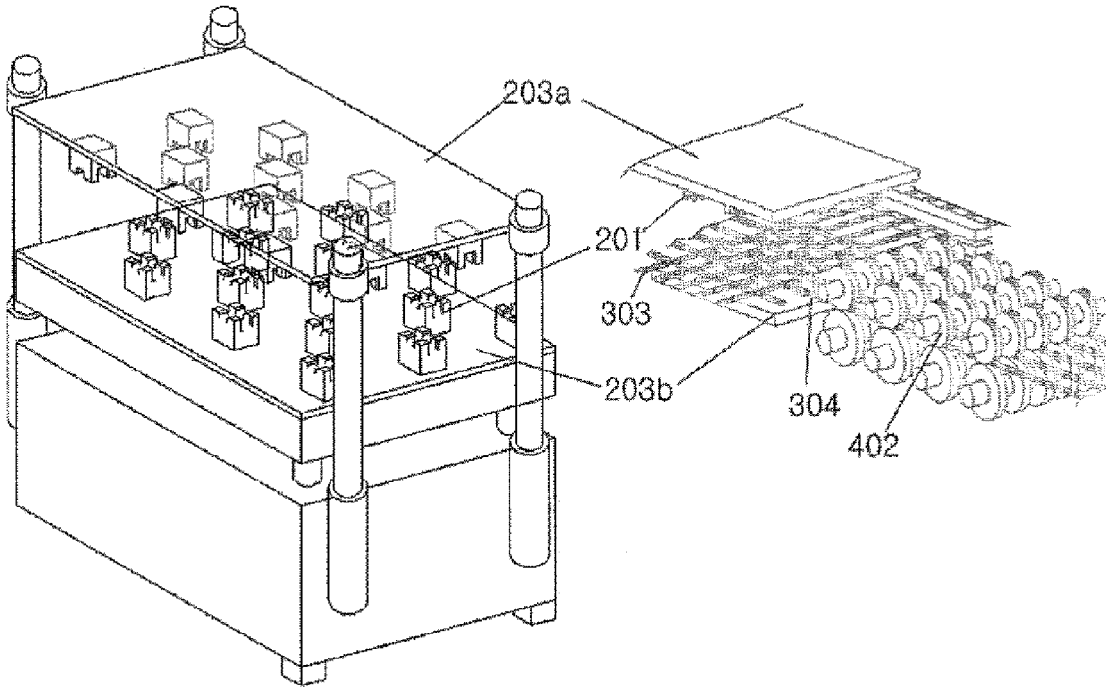

【Figure 3】
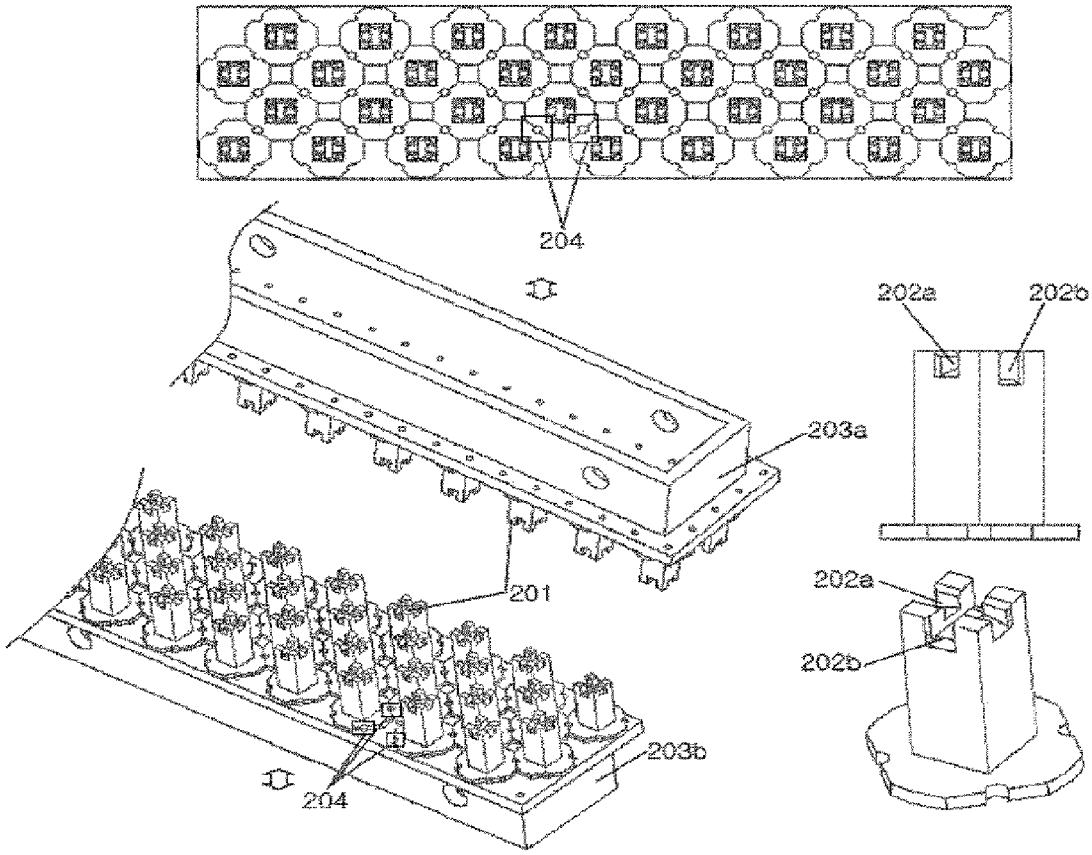

【Figure 4】
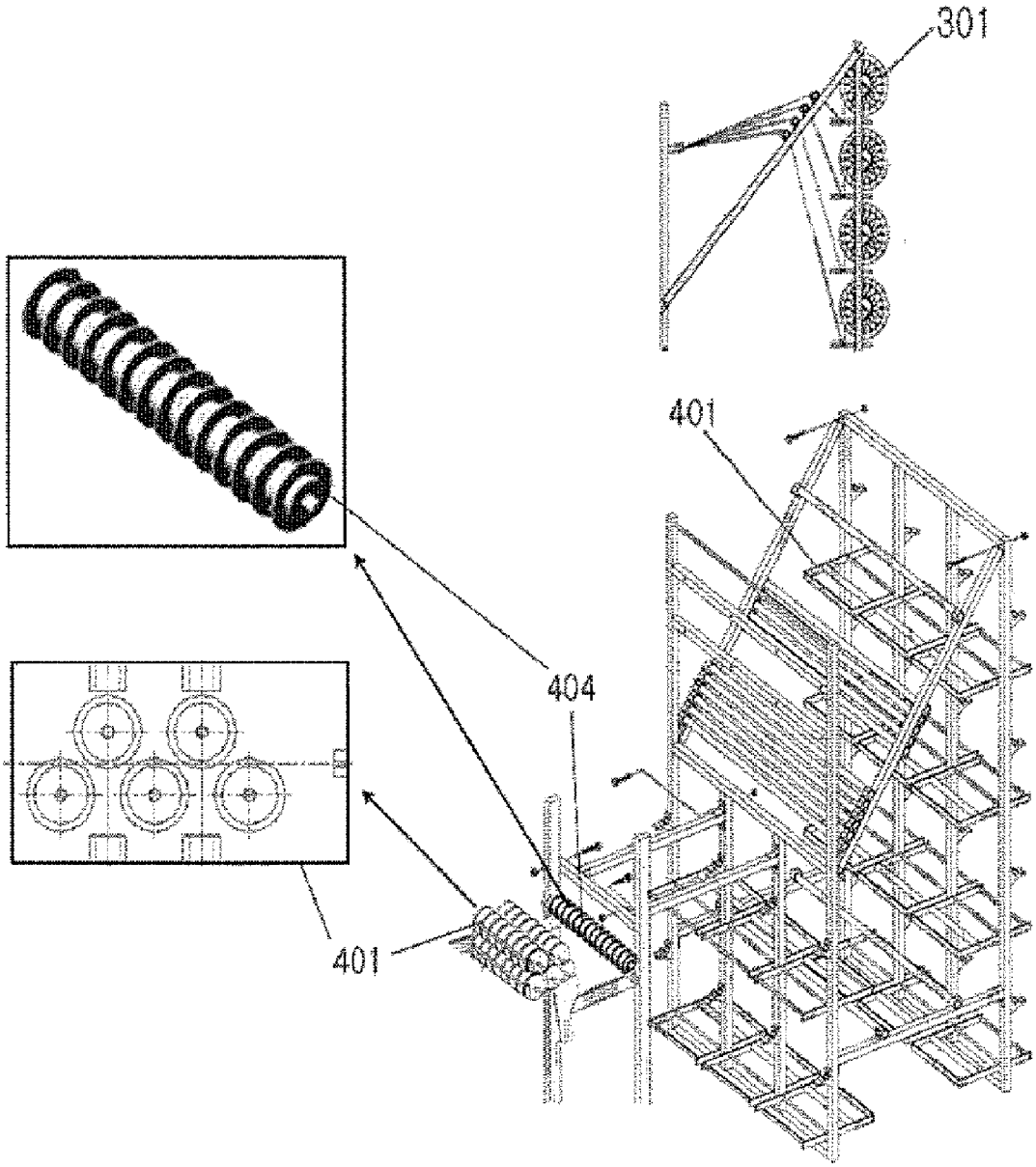

【Figure 5】
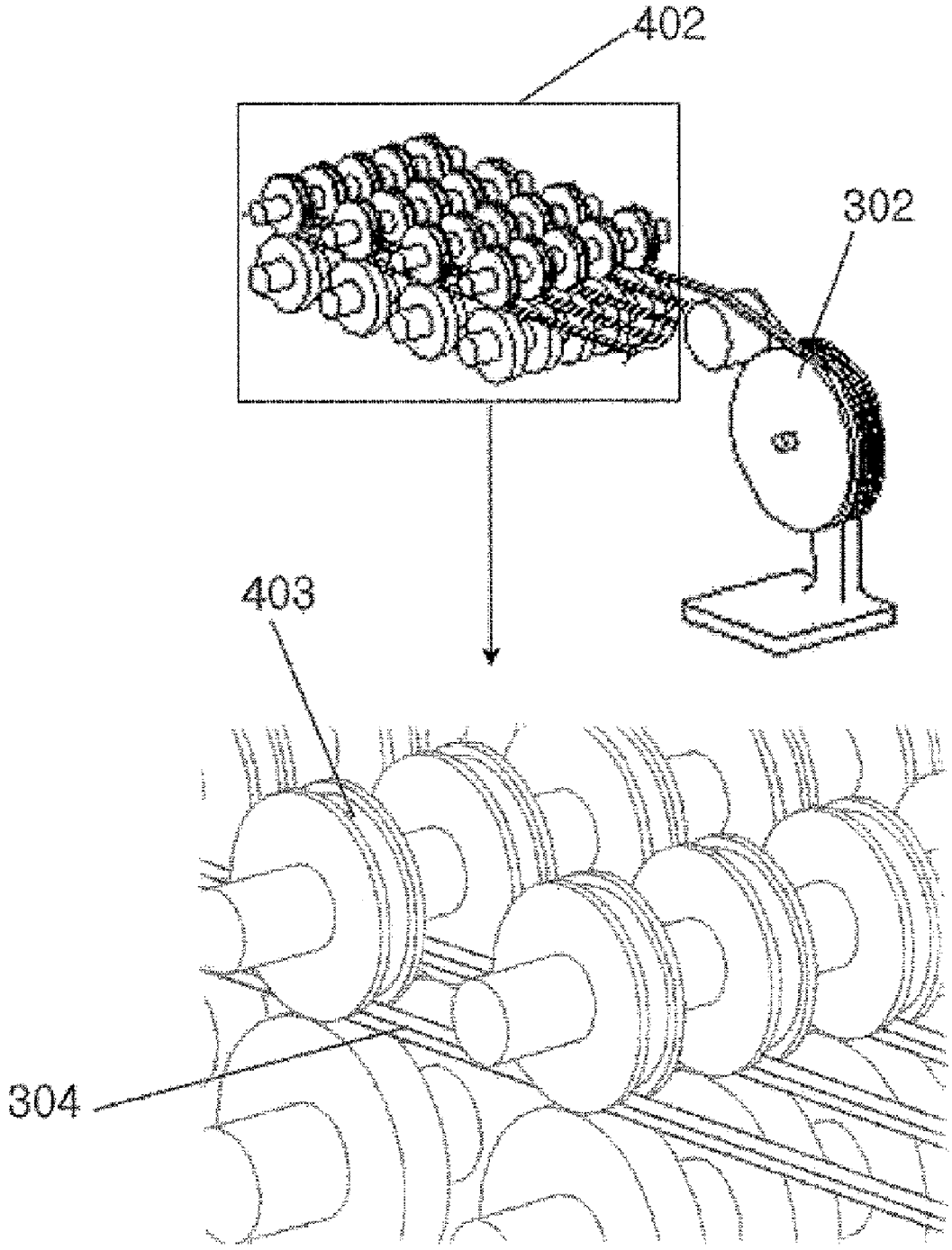

【Figure 6】
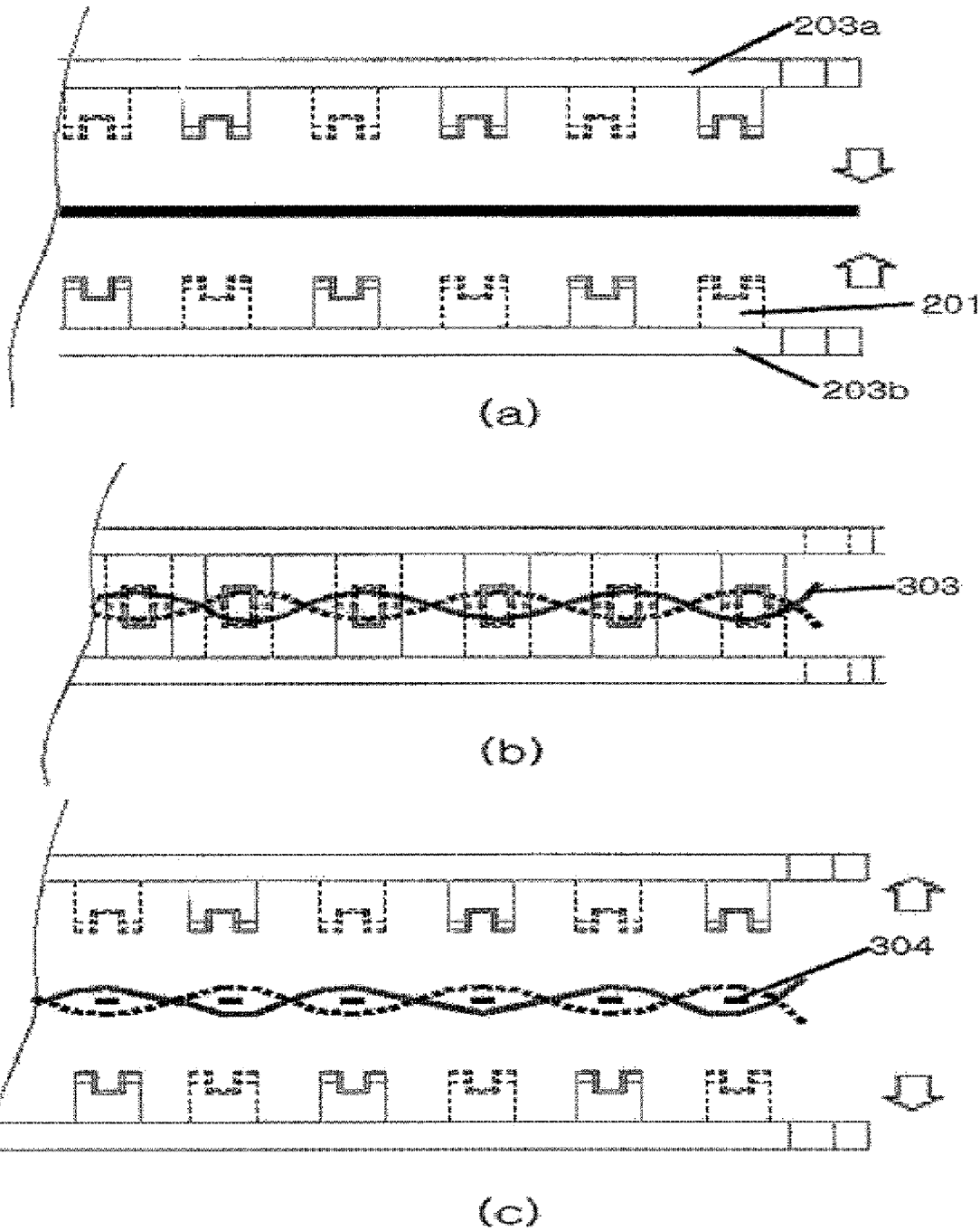

【Figure 7】
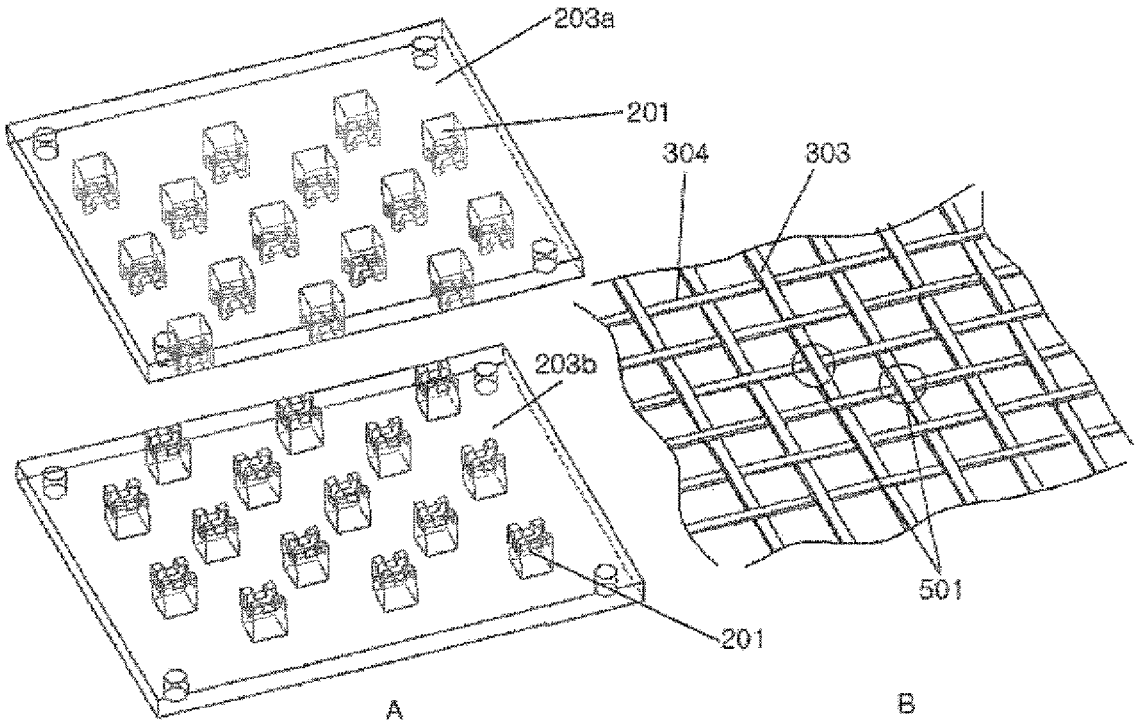

【Figure 8】
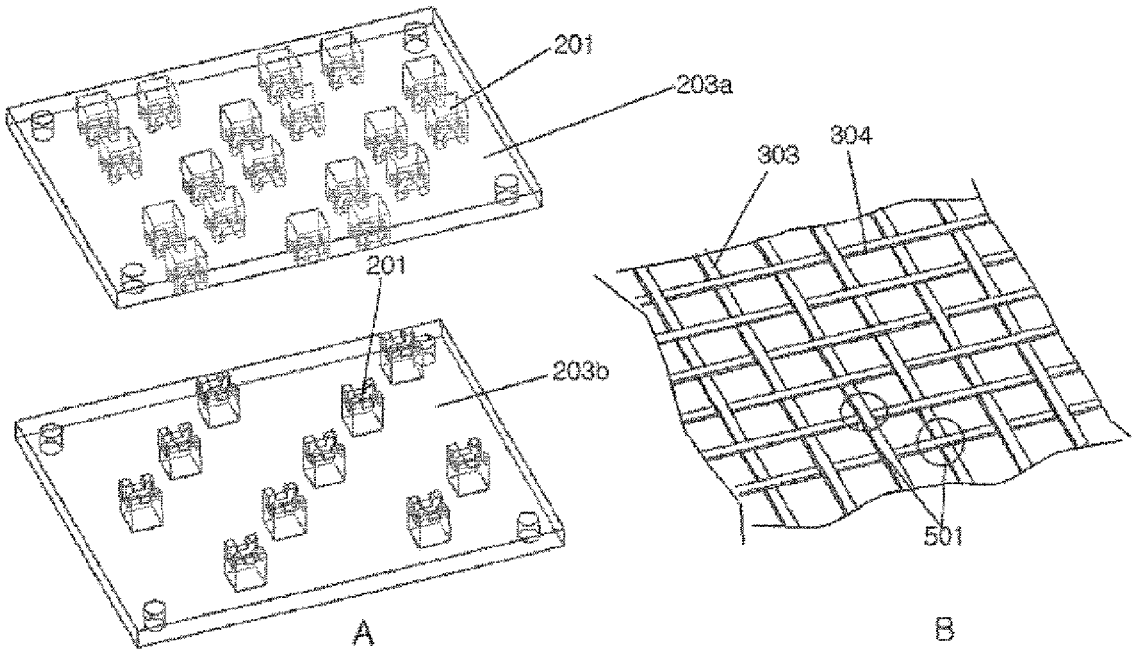

【Figure 9】
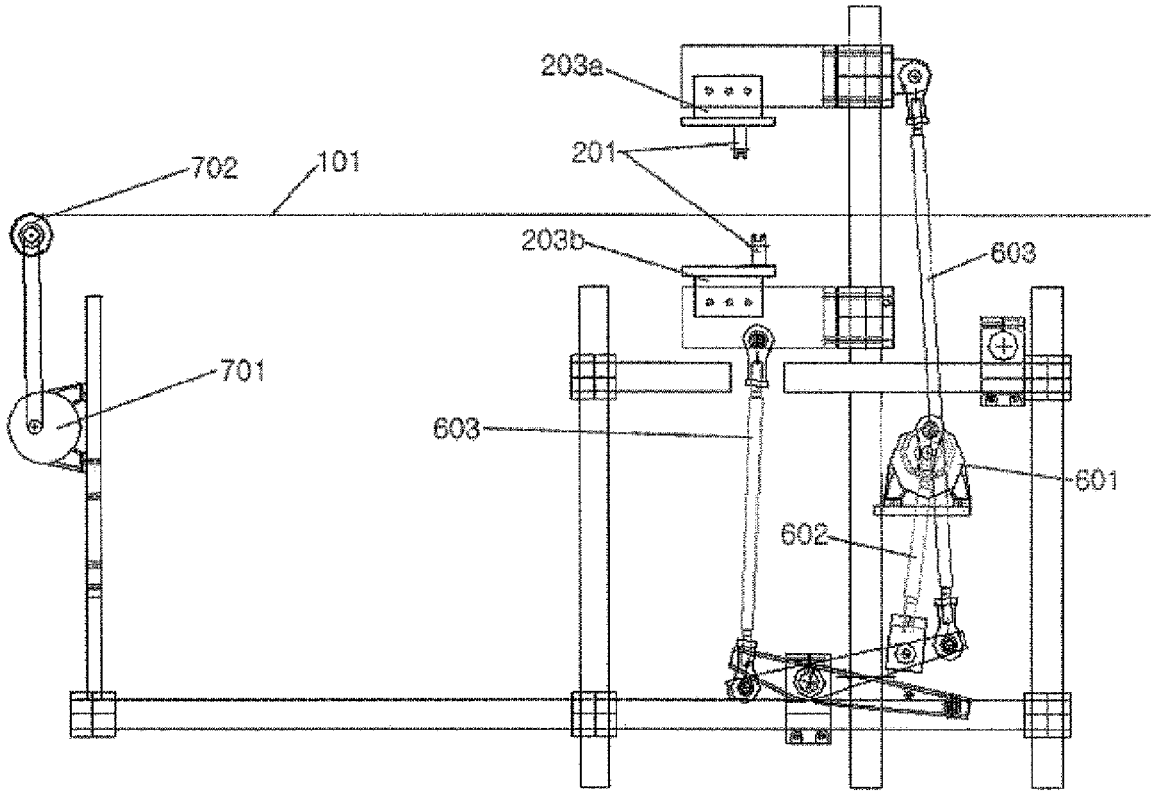

【Figure 10】
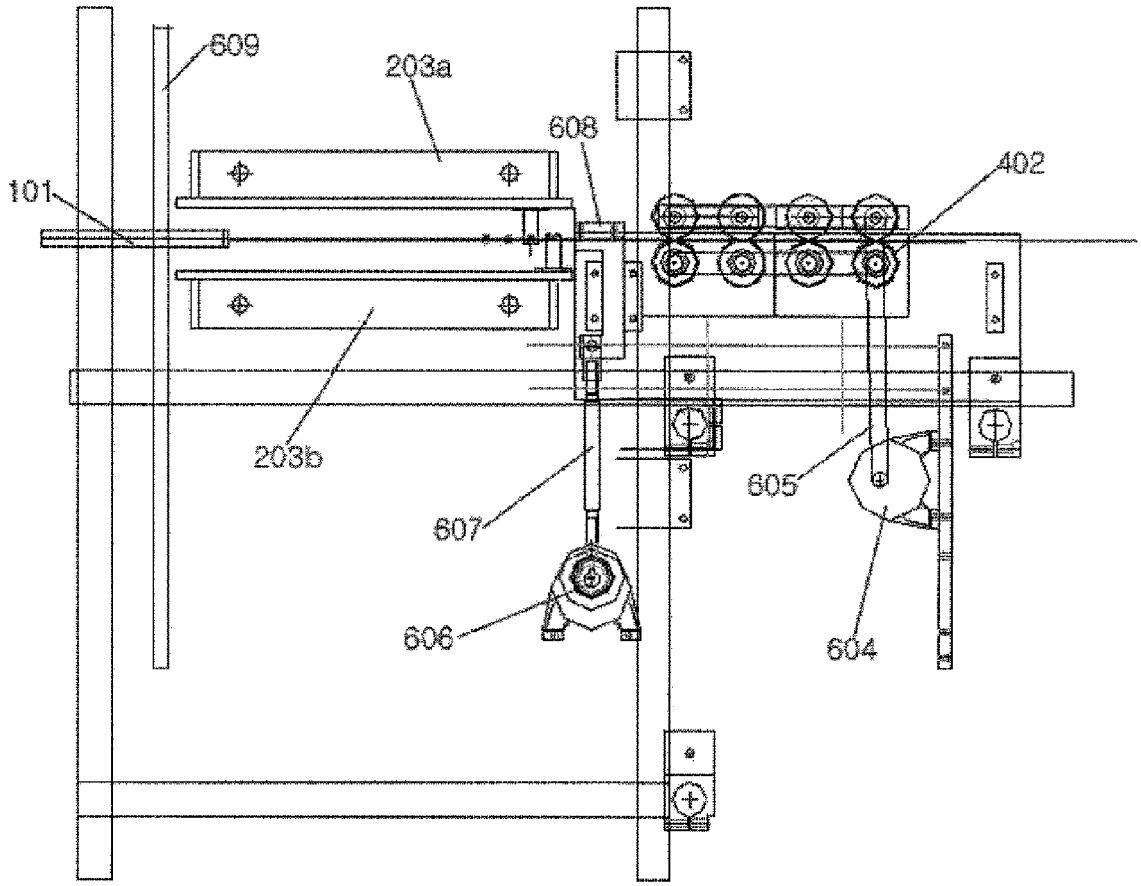

MULTI WEFTS INSERTING WEAVING MACHINE FOR LATTICE WOVEN STRUCTURE

CROSS-REFERENCE TO RELATED APPLICATIONS

The present application is a continuation of International Application of PCT/KR2004/003365 filed on Dec. 21, 2004, which is incorporated herein by reference.

TECHNICAL FIELD

The present invention relates to a multi-wefts inserting weaving machine for a lattice woven structure for industrial purposes, and particularly to a multi-wefts inserting weaving machine comprising a block arraying device and a plural number of unit blocks on the internal surface of the block arraying device.

BACKGROUND ART

An intersectional lattice structure is conventionally used for reinforcing materials of public works, construction structures and so forth.

In order for making an intersectional lattice structure of heavy-duty material, it is preliminarily required to wave the material in a regular pattern. Although it has conventionally been accomplished by up and down movements of a heald, the conventional weft inserting weaving machines such as a projectile weaving machine and a shuttle weaving machine had difficulties in employing the heavy-duty weft material. Further, the products of the conventional weaving machines are limited in weft-directional width.

Accordingly, the present inventors have endeavored to develop the present weaving machine capable of weaving a wide lattice structure for industrial purposes, wherein the weft-directional width of the product is theoretically unlimited by increasing the number of rows of unit blocks and a plural number of heavy-duty wefts are simultaneously inserted.

DESCRIPTION OF DRAWINGS

The objects and features of the present invention will be better understood from the following description of the invention, when taken injunction with the accompanying drawings which respectively show:

FIG. 1: a perspective view of the weaving machine of the present invention;

FIG. 2: a perspective view of the block arraying device of the present weaving machine;

FIG. 3: a perspective view of upper and lower plates of the block arraying device of the present invention;

FIG. 4: a perspective view of a warp-directional tension controlling guide of the present weaving machine;

FIG. 5: a perspective view of weft supplying rollers of the present weaving machine;

FIG. 6: a diagrammatic view of operation mechanism of the block arraying device of the present weaving machine;

FIG. 7: a diagrammatic view of a plain lattice woven structure and a block arraying device therefor;

FIG. 8: a diagrammatic view of a twill lattice woven structure and a block arraying device therefor;

FIG. 9: a weft-directional view of the operational part of the present weaving machine.

FIG. 10: a warp-directional view of the operational part of the present weaving machine.

101: lattice woven structure

201: unit block, 202: rectangular grooves, 202*a*: warp-directional groove, 202*b*: weft-directional groove, 203 block arraying device, 203*a*: upper plate, 203*b*: lower plate, 204: combining groove,

301: warp creel, 302: weft creel, 303: warp, 304: weft,

401: tension controlling guide, 402: weft supplying roller, 403: guide groove, 404: warp distributing roller,

501: contacting point,

601: transfer motor, 602: transfer crank, 603: transfer rod, 604: weft inserting motor, 605: belt, 606: shearing motor, 607: shearing crank, 608: shearing blade, 609: weft sensor,

701: take-up motor, 702: take-up roller

SUMMARY OF THE INVENTION

Accordingly, an object of the present invention is to provide a multi-wefts inserting weaving machine which can easily produce a lattice woven structure from heavy-duty materials, and the method of producing the lattice woven structure thereby.

Another object of the present invention is to provide a multi-wefts inserting weaving machine which can weave lattice woven structures of various patterns as desired and the method of producing the lattice woven structures of various patterns thereby.

A further object of the present invention is to provide a method of producing a wide lattice woven structure at a high rate.

In accordance with the object of the present invention, there is provided a multi-wefts inserting weaving machine, comprising a block arraying device (203) comprising upper (203*a*) and lower (203*b*) plates which face each other and are movable upward and downward; and a plural number of unit blocks (201) attached to the internal facing sides of the upper and lower plates of the block arraying device (203), wherein the unit blocks include two grooves (202*a* and *b*). Further, the present invention provides a method for producing the lattice woven structure, comprising arraying the unit blocks (201) alternatively on the internal sides of facing upper (203*a*) and lower (203*b*) plates with accord to a desired pattern of lattice; locating warps (303) between upper and lower plates at specific intervals; waving the warps along warp-directional grooves (202*a*) on the surfaces of the unit blocks by approaching the upper and lower plates each other, to form openings for inserting wefts (201); and inserting wefts through weft-directional grooves (202*b*) on the surfaces of the unit blocks (201).

In accordance with another object of the present invention, there is provided a multi-wefts inserting weaving machine wherein the unit blocks are reversibly attached to the internal sides of the upper and lower plates of the block arraying device; and also provided a method for producing lattice woven structures of a variety of the lattice intervals and patterns by varying attaching points and a quantity of the unit blocks to the internal sides of the upper and lower plates.

In accordance with the further object of the present invention, there is provided a method of producing the wide lattice woven structure by increasing a quantity of the rows of unit blocks in a weft-direction, and also provided a method of producing the lattice woven structure at a high rate by increasing a quantity of the rows of unit blocks in a warp-direction.

DETAILED DESCRIPTION OF THE INVENTION

The lattice structure of the present invention represents any structure used for industrial purposes wherein warp and weft are intersected each other.

Referring to FIGS. 1, 9 and 10, the multi-wefts inserting weaving machine of the present invention comprises a block arraying device (203) which is followed by a tension controlling guide (401), warp distributing rollers (404) and warp creels (301) in a warp-direction. A take-up roller (702) for taking up a lattice woven structure produced is equipped preceding the block arraying device in a warp-direction, and an apparatus for binding the wefts and warps at contact points in the lattice woven structure may be optionally employed between the block arraying device (203) and the take-up roller (702). In a weft-direction, the block arraying device is followed by weft supplying rollers (402) and weft creels successively, and preceded by a weft sensor (609). A shearing apparatus including a shearing motor (606), a shearing crank (607) and a shearing blade (608) is located between the block arraying device (203) and the weft supplying roller (402). An operational part of the present weaving machine is located under the block arraying device (203).

In the present invention, the lattice woven structure is obtained by arraying the unit blocks (201) on the internal facing side of upper (203*a*) and lower (203*b*) plates alternatively in accordance with a desired pattern of lattice; locating warps (303) between the upper and lower plates at specific intervals; waving the warps along warp-directional grooves (202*a*) on the surfaces of the unit blocks (201) by approaching the upper and lower plates each other to form openings for inserting wefts with weft directional grooves on the surfaces of the unit blocks; and inserting wefts along weft directional grooves (202*b*) on the surfaces of the unit blocks (201).

Hereinafter, the feature of each part of the present weaving machine is described with taken injunction with the accompanying drawings.

Referring to FIG. 2, the block arraying device (203) comprises an upper plate (203*a*) and a lower plate (203*b*) facing each other. Combining grooves (204) for attaching unit blocks to the plates are installed inside (facing side) of each plate.

In the present invention, the unit blocks are attached to the internal sides of upper (203*a*) and lower (203*b*) plates through the combining grooves (204). The unit blocks (201) are alternatively arrayed on the internal sides of the upper (203*a*) and lower (203*b*) plates in accordance with a desired pattern of lattice structure. In other words, the unit blocks on the upper plate and the unit blocks on the lower plate do not contact each other but are arrayed in neighbors and/or turns to wave the warps along the grooves on the surfaces of the unit blocks and form the openings for wefts when the upper and lower plates approach each other. The attaching points (501) of the unit blocks on the block arraying device represent contact points of the warps and wefts in the lattice woven structure. Total number of the unit blocks arrayed on the upper (203*a*) and the lower (203*b*) plates are same as the number of the contact points (501) of the warps and wefts in the lattice structure. Preferably, the unit blocks reversibly attach to the upper and lower plates so that the attaching positions of the unit blocks can be varied in accordance with the lattice intervals and patterns of the desired lattice woven structure.

Referring to FIG. 3, the unit blocks include two grooves (202*a, b*) on their surfaces. In one embodiment, the unit blocks are hexahedral, and the two grooves (202*a, b*) are rectangular and cross at a right angle, i.e., weft (202*b*) and warp (202*a*) directions. In a preferred embodiment, the two grooves may be installed in different depths as shown in FIG. 3. When attaching to the internal sides of the upper (203*a*) and lower (203*b*) plates, the unit blocks may be oriented so as that the weft (304) is supplied through a deeper one (202*b*) of the two grooves. The two grooves may be smoothed and rounded to facilitate the insertion of the weft and the warp. Further, the width and depth of the grooves (202) may be varied depending on the dimension and the hardness of the warp and the weft. In one embodiment, an attaching apparatus is equipped on the back surface of the unit blocks for reversible attaching to the combining grooves (204) of the upper or lower plate.

The warp is supplied to the block arraying device from the warp creel (301) through the warp distributing roller (404) and the tension controlling guide (401). The warp distributing roller keeps specific distances between the neighboring warps, for example the same distance as the intervals of the warp-directional rows of the unit blocks which are arrayed in accordance with the gauge of the desired lattice structure. A conventional tension controlling guide may be employed in the present weaving machine. For instance, as shown in FIG. 4, the tension controlling device may have five (5) rollers which are alternatively arranged up and down.

A weft supplying roller (402) is equipped at each weft-directional row of the unit blocks and guides the weft of various dimensions to the weft directional groove (202*b*) on the unit block. In one embodiment, the weft supplying roller (402) consists of a plural number of conventional rollers, e.g., four (4) rollers in each of upper and lower parts, as shown in FIG. 5. The number of rollers may be varied depending on the weft material. Further, surface of the weft supplying roller (402) may include a guide groove (403) to level the weft, prevent the secession of the weft, and control the tension of the weft. The width and depth of the guide groove (403) may be varied depending on the dimension of the weft.

FIG. 6 diagrammatically shows the operation mechanism of the block arraying device of the present weaving machine from a weft-directional side. The unit blocks of solid line (201*a*) and of dotted line (201*b*) represent those arrayed in different rows when viewed from a warp-directional side. In FIG. 6(*a*), the warps (303) are located between upper (203*a*) and lower (203*b*) plates, the upper plate descends and the lower plate rises. As indicated in FIG. 6(*b*), when the upper and lower plates approach sufficiently close, the warp is waved along the warp directional grooves (202*a*) on the unit blocks, to form the weft directional openings for inserting weft. Subsequently, the weft is inserted into the opening along the weft-directional groove (202*b*) on the unit block to form a lattice woven structure as seen in FIG. 6(*c*). The wefts are supplied by the weft supplying rollers (402) and cut by the shearing apparatus including a shearing motor (606), a shearing crank (607) and a shearing blade (608) when the ends of the wefts contact the weft sensor (609). Lastly, as seen in FIG. 6(*c*) the upper plate rises and the lower plate (203*b*) descends to release a lattice woven structure (101).

The present weaving machine may further comprise an apparatus for binding the wefts and the warps at contact points such as a point welding apparatus and a thermo-fusion roller. The binding apparatus may be chosen depending on the physical properties of the weft and the warp.

The present multi-wefts inserting weaving machine is able to produce lattice woven structures of various lattice intervals and patterns by varying the quantatiy and the attaching points of the unit blocks to the internal sides of the upper and lower plates. For instance, a plain lattice structure is obtained by arraying one row of the unit blocks on the upper plate and another row of the unit blocks on the lower plate alternatively in both warp and weft directions and making the total number of rows even. A 2/1 twill lattice structure is obtained by arraying two rows of the unit blocks on the upper plate and another one row on the lower plate alternatively or vice versa. Accordingly the total number of the rows is a multiple of three (3). FIGS. 7 and 8 show the plain and twill lattice structures obtained by the present weaving machine, respectively (the unit blocks array of A results in the lattice structure of B).

The present multi-wefts inserting weaving machine is able to produce the wide lattice woven structure in a high rate by increasing the quantity of the rows of the unit blocks in a weft-direction and a warp-direction. The more are the warp-directional rows of the unit blocks, the more wefts are inserted simultaneously so as to speed up the production of the lattice structure, and the more are the weft-directional rows of the unit blocks, the wider lattice structure is obtained.

The present weaving machine further comprises an operational part under the block arraying device (203). The operational mechanism of the present weaving machine is described with taken injunction with FIG. 9.

The heavy-duty warps, e.g., steel or metal wires are supplied through the tension controlling guide (401) and placed between the upper and lower plates at specific intervals in accordance with the gauge of the desired lattice structure. As shown in FIG. 9, a rotation of a transfer motor (601) drives an up and down movement of transfer rods (603) which are connected to the upper and lower plates through transfer cranks (602), subsequently to lead a downward movement of the upper plate and an upward movement of the lower plate so as to wave the warps to form openings for the wefts. A rotation of a weft inserting motor (604) drives a rotation of the weft supplying roller (402) and the weft is supplied along a series of the weft directional grooves (202*b*) on the unit blocks to form a lattice structure (101). When the ends of the wefts contact the weft sensor (609), a rotation of the shearing motor (606) is delivered to an up and down movement of the shearing blade (608) through the shearing crank (607) by an electric relay method, and the wefts are cut by a same length in accordance with the width of the lattice structure. The lattice woven structure (101) is transferred and taken up by the take-up roller (702) driven by a take-up motor (701) located at a warp-directional advance of the block arraying device (203). Before the lattice structure taken up, the wefts and the warps may be bound at contact points (501) by a binding apparatus such as a point welding apparatus and a thermo-fusion roller. The binding apparatus may be chosen depending on the physical properties of the weft and the warp.

The present invention provides a method of producing a lattice woven structure by using the multi-wefts inserting weaving machine of the present invention, comprising:

arraying unit blocks (201) on internal sides of an upper plate (203*a*) and a lower (203*b*) plate in accordance with a pattern of a desired lattice woven structure (101);

locating warps (303) between the upper plate (203*a*) and the lower plate (203*b*) at specific intervals;

waving the warps (303) along warp-directional grooves (202*a*) on surfaces of the unit blocks (201) by approaching the upper (203*a*) and lower (203*b*) plates; and inserting wefts (304) along weft directional grooves (202*b*) on surfaces of the unit blocks (201).

Hereinafter, each step of the method of the present invention is described in case of a plain lattice structure.

(1) arraying the unit blocks on internal sides of the upper plate and the lower plate The unit blocks are arrayed on the internal (facing) sides of the upper and lower plates of the block arraying device in accordance with the pattern of a desired lattice woven structure. One row of the unit blocks are arrayed on the upper plate and another row on the lower plate alternatively in both weft and warp directions. That is, one unit block on the upper plate is neighbored with four unit blocks on the lower plate and vice versa when the upper and lower plates approach each other. Total number of the rows of the unit blocks is even. The interval of the rows may be 10 to 100 mm, preferably 30 to 70 mm in both weft and warp directions.

(2) locating warps between the upper plate and the lower plate

The warps, e.g., thick fiber or heavy-duty material, prepared in the creels (301) are supplied to the block arraying device (203) along the tension controlling guide roller (401) maintaining specific intervals such as same intervals as the warp-directional rows of the unit blocks by the warp distributing roller (404). Further, the warp may be linearized by a heating apparatus employed in the tension controlling guide (401) before supplied.

(3) waving the warps by approaching the upper plate and the lower plate

The warps (303) are waved along the warp directional grooves (202a) on the unit block (201) by approaching the upper plate (203*a*) and the lower plate (203*b*), to form weft-directional openings which consist of the weft directional grooves (202*b*) on the unit blocks for inserting the wefts.

(4) inserting the wefts

The wefts (304) prepared in the weft creels (302) are supplied along the weft-directional grooves (202*a*) by the weft supplying rollers (402) wherein guide grooves (403) are installed on the surface to level the weft, prevent the secessions of the wefts, and control the tension of the wefts. The depth and width of the guide grooves (403) are varied depending on the dimension of the weft. The heating apparatus may also be employed in the weft supplying rollers to linearize the wefts. The wefts also keep specific intervals each other, for example the same interval as the weft-directional rows of the unit blocks.

The present invention provides a method of producing lattice woven structures of great variety of the lattice intervals and patterns, which comprises varying the quantity of the unit blocks and the attaching points of the unit blocks to the internal sides of the upper and lower plates.

The present invention also provides a method of producing the wide lattice woven structure, which further comprises increasing the quantity of the rows of the unit blocks in a weft-direction and a method of producing the lattice woven structure in a high rate, which further comprises increasing the quantity of the rows of the unit blocks in a warp-direction. The more are the warp-directional rows of the unit blocks, the more wefts are inserted simultaneously so as to speed up the production of the lattice structure. The more are the weft-directional rows of the unit blocks, the wider lattice structure is obtained.

The method of the present invention may further comprise binding together the warps and the wefts at contact points by a binding apparatus such as a point welding apparatus and a thermo-fusion roller. The binding apparatus may be chosen depending on the physical properties of the weft and the warp.

Accordingly, the lattice woven structure of the heavy-duty materials can be easily woven by the present multi-wefts inserting weaving machine, and the lattice woven structures of various patterns can be obtained by varying the quantity and the attaching positions of the unit blocks.

The multi-wefts inserting weaving machine of the present invention can produce the wide lattice woven structure which is capable of simplifying processes in the public works or construction, as well as speed up the production of the lattice woven structure.

While the invention has been described with respect to the above specific embodiments, it should be recognized that various modifications and changes may be made to the invention by those skilled in the art which also fall within the scope of the invention as defined by the appended claims.

The invention claimed is:

1. A multi-wefts inserting weaving machine comprising:

a block arraying device comprising an upper plate and a lower plate which face each other and are movable upward and downward; and a plural number of unit blocks attached to internal facing sides of said upper and lower plates of said block arraying device, said unit blocks include two grooves configured to receive warp and weft yarns.

2. The multi-wefts inserting weaving machine of claim 1, wherein one groove of said two grooves is deeper than the other groove.

3. The multi-wefts inserting weaving machine of claim 2, wherein said unit blocks are arrayed such that said deeper groove is weft-directional.

4. The multi-wefts inserting weaving machine of claim 1 further comprising weft supplying rollers on a weft-directional rear side of said block arraying device.

5. The multi-wefts inserting weaving machine of claim 4, wherein surface of said weft supplying roller includes a guide groove.

6. The multi-wefts inserting weaving machine of claim 1, wherein said unit blocks are reversibly attached to said internal facing sides of said upper and lower plates of said block arraying device.

7. The multi-wefts inserting weaving machine of claim 1, wherein said unit blocks are attached to said internal facing sides of said upper and lower plates of said block arraying device through combining grooves on said internal facing sides of said upper and lower plates.

8. The multi-wefts inserting weaving machine of claim 1 further comprising an apparatus for binding together warps and wefts at contact points on a warp-directional advance side of said block arraying device.

9. A method of producing a lattice woven structure by using a multi-wefts inserting weaving machine, comprising:

arraying unit blocks on internal sides of an upper plate and a lower plate of a block arraying device;

locating warps between said upper plate and said lower plate at specific intervals;

waving the warps along warp-directional grooves on surfaces of said unit blocks by approaching said upper plate and lower plate; and inserting wefts along weft directional grooves on surfaces of said unit blocks.

10. The method of claim 9 further comprising varying a quantity of said unit blocks and attaching points of said unit blocks to said internal sides of said upper and lower plates in accordance with a pattern of a desired lattice woven structure.

11. The method of claim 9 further comprising increasing a quantity of rows of said unit blocks in a weft-direction.

12. The method of claim 9 further comprising increasing a quantity of rows of said unit blocks in a warp-direction.

13. The method of claim 9 further comprising binding together the warps and the wefts at contact points.

* * * * *

UNITED STATES PATENT AND TRADEMARK OFFICE

CERTIFICATE OF CORRECTION

PATENT NO. : 7,168,453 B2
APPLICATION NO. : 11/426695
DATED : January 30, 2007
INVENTOR(S) : Chon et al.

It is certified that error appears in the above-identified patent and that said Letters Patent is hereby corrected as shown below:

In Claim 1, Line 8, replace “warp yarns” with --warps-- and replace “weft yarns” with --wefts--.

Signed and Sealed this

Eighth Day of May, 2007

JON W. DUDAS
*Director of the United States Patent and Trademark Office*